US005133514A

United States Patent [19]

Inoue

[11] Patent Number: 5,133,514

[45] Date of Patent: Jul. 28, 1992

[54] YARN PROCESSING METHOD FOR TAIL END

[75] Inventor: Kazuyuki Inoue, Kyoto, Japan

[73] Assignee: Murata Kikai Kabushiki Kaisha, Kyoto, Japan

[21] Appl. No.: 627,039

[22] Filed: Dec. 13, 1990

[30] Foreign Application Priority Data

Dec. 18, 1989 [JP] Japan ..... 1-327848

[51] Int. Cl.[5] ..... B65H 54/02

[52] U.S. Cl. ..... 242/18 EW; 242/165

[58] Field of Search ..... 242/18 EW, 18 PW, 18 R, 242/164, 165

[56] References Cited

U.S. PATENT DOCUMENTS

| | | | |
|---|---|---|---|
| 1,444,414 | 2/1923 | Colman | 242/18 EW X |
| 1,614,718 | 1/1927 | Colman | 242/18 EW X |
| 1,614,879 | 1/1927 | Colman | 242/18 EW X |
| 2,035,721 | 3/1936 | Reiners et al. | 242/18 EW X |
| 4,025,002 | 5/1977 | Sutton, III et al. | 242/18 EW X |

*Primary Examiner*—Stanley N. Gilreath

*Attorney, Agent, or Firm*—Spensley, Horn, Jubas & Lubitz

[57] ABSTRACT

A yarn processing method for a tail end of a yarn of a package. A tail end of a package is dropped at its end from a yarn layer of the package to cross the end of the package, after which it is returned onto the yarn layer so that the tail end is easily searched out in a later step.

4 Claims, 3 Drawing Sheets

YARN PROCESSING METHOD FOR TAIL END

FIELD OF THE INVENTION

The present invention relates to a yarn processing method for winding a tail end which is a yarn end finally wound around a package, and particularly to a yarn processing method for a tail end, which includes specifying a position of the tail end, and easily releasing the tail end in the later step.

RELATED ART STATEMENT

A fine spinning bobbin produced by a fine spinning frame, particularly, by a ring fine spinning frame is supplied to a winder and rewound into a package having a predetermined amount of yarn and shape.

That is, a yarn on a fine spinning bobbin supplied to a predetermined position of a winding unit of each winder is drawn axially of the bobbin, and a yarn disengaged from a yarn layer runs while being subjected to ballooning, and is wound on the package while being traversed by a traverse device. A fully wound package is carried to, for example, a twisting step. In the twisting step, a tail end (a finally wound yarn end) of the package is searched for in order to release a yarn.

In order to facilitate the release of yarns, yarn processing is employed in which as shown in FIGS. 9 and 10, the tail end e is moved to the yarn release side of the core of a paper tube 1, a take-up tube 2 or the like and wound to form a bunch winding 3. This yarn processing is advantageous in that the tail end is easily searched and is hard to disappear.

In the yarn processing method of this kind, since the tail end e is present on the core of the paper tube 1, the take-up tube 2 or the like, it can be easily searched. However, in the case where the paper tube 1 is a paper tube, having ends which are bent in or in the case where the take-up tube 2 is a so-called cone having a large taper, as shown, there poses a problem in that the bunch winding 3 is slipped off from the paper tube 1 or the take-up tube 2.

OBJECT AND SUMMARY OF THE INVENTION

In view of the aforesaid problems, an object of the present invention is to provide a yarn processing method for an end tail which can definitely specify a position of a tail end of a package, prevent the tail end from being slipped off, and facilitate the removal of the tail end in the later step.

In accordance with the present invention, a tail end of a package is dropped at its end from a yarn layer to cross the end of the package, after which it is returned onto the yarn layer.

According to the aforesaid structure, since the tail end of the package crosses the end of the package, it is easily searched out in a later step. Furthermore, since the tail end is returned to the yarn layer and wound, the frictional resistance is so large that the tail end is not slipped off and can be easily released in the later step.

DETAILED DESCRIPTION OF PREFERRED EMBODIMENT

A preferred embodiment of the present invention will be described in detail with reference to the accompanying drawings.

Figure 7:
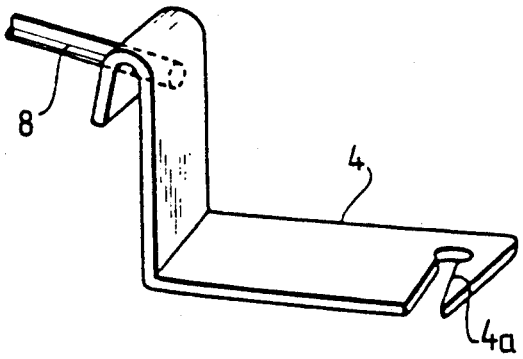
FIG. 7 is a perspective view showing a conventional L-shaped lever.
Figure 8:
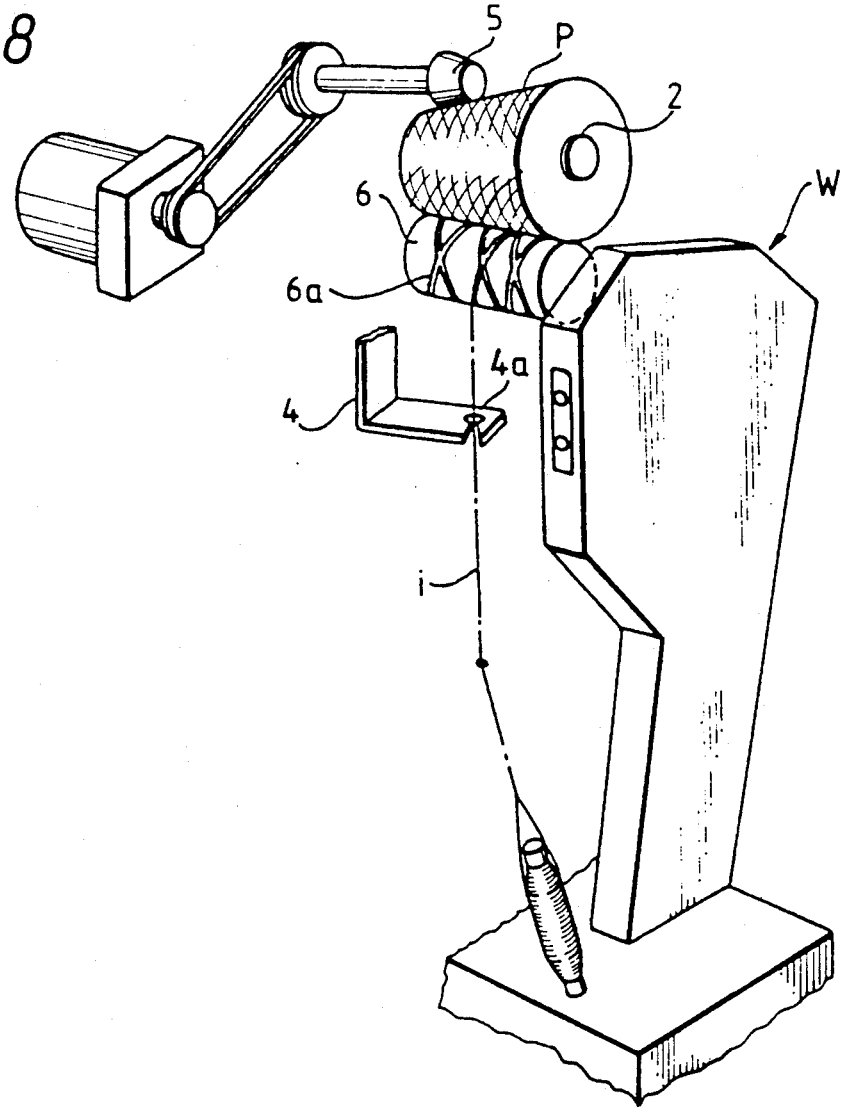
FIG. 8 is a schematic view showing a conventional winder.

As shown in FIGS. 7 and 8, a package P wound by a winder W is subjected to doffing by AD (auto doffer) not shown and is replaced by a take-up core 2 of an empty paper tube, a take-up tube or the like. A L-shaped lever 4 provided on the AD is rotated and moved downward so as to grasp the yarn i at the beginning of winding.

Next, a roller 5 for rotating a package provided so as to contact the package P is rotated so that the yarn i is guided to a traverse groove 6*a* of a traverse drum 6 and guided in a yarn guide groove 4*a* formed in the L-shaped lever 4.

Figure 1:
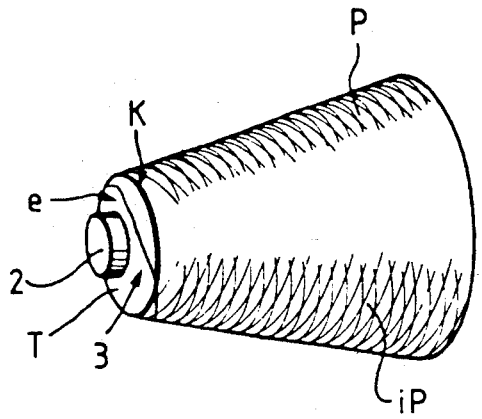
FIG. 1 is a perspective view showing one embodiment of a yarn processing method according to the present invention.

When the yarn i is supplied to the package P so that the latter is fully wound in the manner as described above, the tail end e which is a finally wound yarn end is moved to the yarn processing for winding the yarn on the package P as shown in FIG. 1 prior to cutting of yarn by the AD.

Particularly, in the yarn processing, the tail end e of the package P is dropped at the end from the yarn layer iP to cross an end T on the small diameter side of the package P, after which it is returned onto the yarn layer iP. That is, the tail end e on the yarn layer iP is once disenged from the yarn layer iP along the end T of the package P and again returned to the yarn layer iP.

In the present embodiment, the cone-like package P is formed, and the tail end e on the small diameter side which is the release side in the later step of the package P is wound. The tail end e after being disengaged from the yarn layer iP crosses chordwise the end T which is the small diameter side of the package P between the core 2 and a corner portion K of the package P and is again obliquely wound on the yarn layer iP. That is, the tail end has moved half of the surface portion of the yarn layer iP, and thereafter crosses the end T of the package P so as to surround the core 2 with the latter positioned inwardly and is pulled back to the yarn layer iP. The tail end e depicts a substantially semi-circular orbit to form the bunch winding 3.

In this case, when the tail end e crosses the end T of the package P, the tail end e may be brought into contact with the surface portion of the core 2 for engagement therewith, or the core is positioned externally to form the bunch winding 3 which depicts a small half circle. In the case where the tail end e is the bunch winding 3 in engagement with the winding tube 2, the tail end e is engaged at the yarn layer iP and caught by the core 2. For this reason, the bunch winding 3 is hard to break.

Such a bunch winding 3 is wound once or several times.

Accordingly, the bunch winding 3 in multiple windings repeats the steps, through the number of windings, such steps including dropping the tail end e at the end from the yarn layer iP and again pulling it back to the yarn layer iP.

Figure 2:
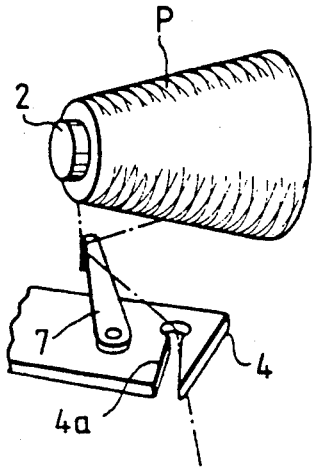
FIG. 2 is a perspective view showing the state of a bunch winding according to the present invention.

In order to achieve the yarn processing as described above, in the present embodiment, as shown in FIG. 2, a rotatable guide lever 7 is provided in which the yarn i is caught on the L-shaped lever 4 and guided toward the small diameter side (the end T on the small diameter side) in an axial direction of the package. The guide lever 7 can be changed in its rotational stroke or set position whereby the yarn i supplied to the package P is guided so that the yarn i is dropped at the end from the yarn layer iP and further returned to the yarn layer iP.

Figure 3:
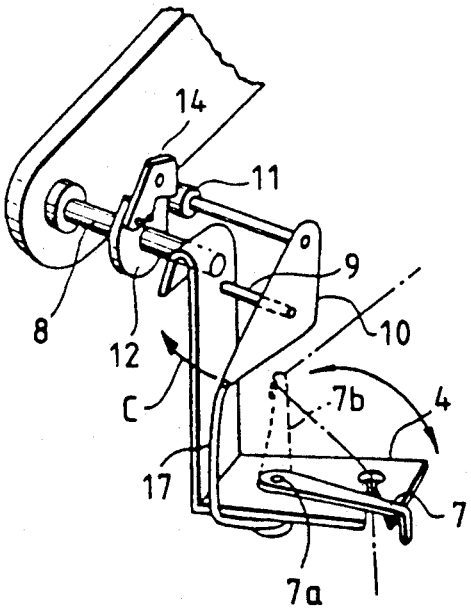
FIG. 3 is a perspective view showing one embodiment of the present invention.

More specifically, as shown in FIG. 3, a lever shaft 8 rotatably supported on the AD is rotated through approx. 180° so that the L-shaped lever 4 is rotated and moved down. The L-shaped lever 4 has a mounting shaft 9 fixedly mounted thereon, and a central portion of a triangular lever 10 is rotatably provided on the mounting shaft 9. A roller with a shaft 11 is mounted on the upper end of the triangular lever 10.

Figure 4:
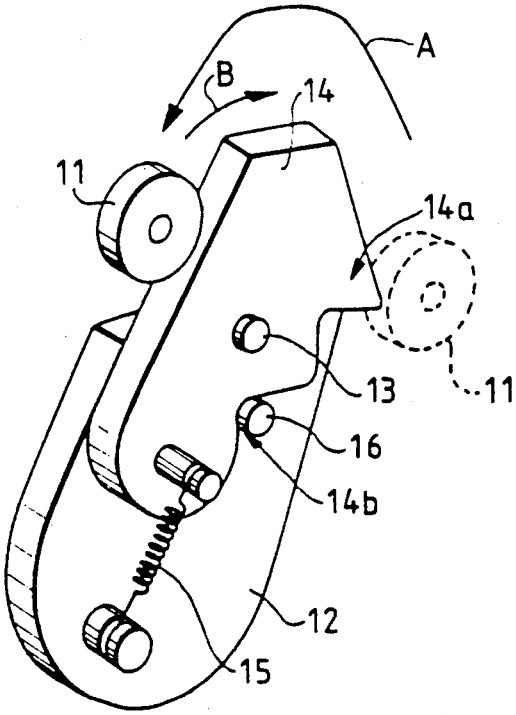
FIG. 4 is an enlarged view showing essential parts of FIG. 3.

The lever shaft 8 is provided with a lever support member 12, and a cam lever 14 which rotates about a pin 13 as shown in FIG. 4 and is rotatably mounted on the lever support member 12. The cam lever 14 is formed at its upper portion with a cam portion 14*a* in engagement with the roller with a shaft 11, and formed at its lower portion with a spring 15 from the lever support member 12.

A recess 14*b* is formed between a mounting portion of the spring 15 of the cam lever 14 and the pin 13, the recess 14*b* being engaged with a stopper pin 16 provided on the lever support member 12 to impair the rotation of the cam lever 14., The guide lever 7 with the extreme end downwardly bent is provided on the L-shaped lever 4 so that the guide lever 7 is rotated while being superposed to the L-shaped lever 4. The rotatable pin 7*a* of the guide lever 7 is connected to the lower end of the triangular lever 10 through a wire 17.

Accordingly, when the L-shaped lever 4 is rotated, the triangular lever 10 is rotated therealong, and the roller with a shaft 11 is moved in a direction indicated at arrow A as shown in FIG. 4. The reason why is that since the turning force of the L-shaped lever 4 is larger than that of the spring 15, the guide lever 7 is rotated about the pin 13 and the triangular lever 10 is not rotated.

When the L-shaped lever 4 tends to be returned to its original position after the yarn has been grasped, the roller with a shaft 11 moves as shown by arrow B because of the presence of a stopper 16. Therefore, the triangular lever 10 rotates clockwise at C, and the wire 17 connected to the lower end of the triangular lever 10 is pulled to rotate the guide lever 7. The guide lever 7 guides the yarn i in the yarn guide groove 4*a* in a direction (the release side of the package P) as shown by the dotted line 7*b* of FIG. 3.

Figure 6:
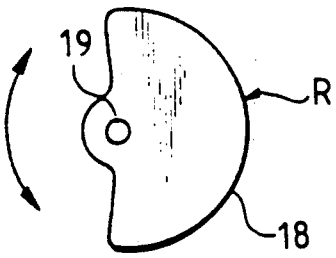
FIG. 6 is a side view showing a conventional. cam.

The bunch winding 3 of the tail end e as shown in FIG. 3 is formed by making constant the curvature R of a cam 18 (as shown in FIG. 6) while continuously operating the cam 18 when the AD is stopped, thereby defining the rotation of the lever shaft 8 and stopping the movement of the guide lever 7. That is, the cam shaft 19 is operatively connected to the lever shaft 8.

Figure 5:
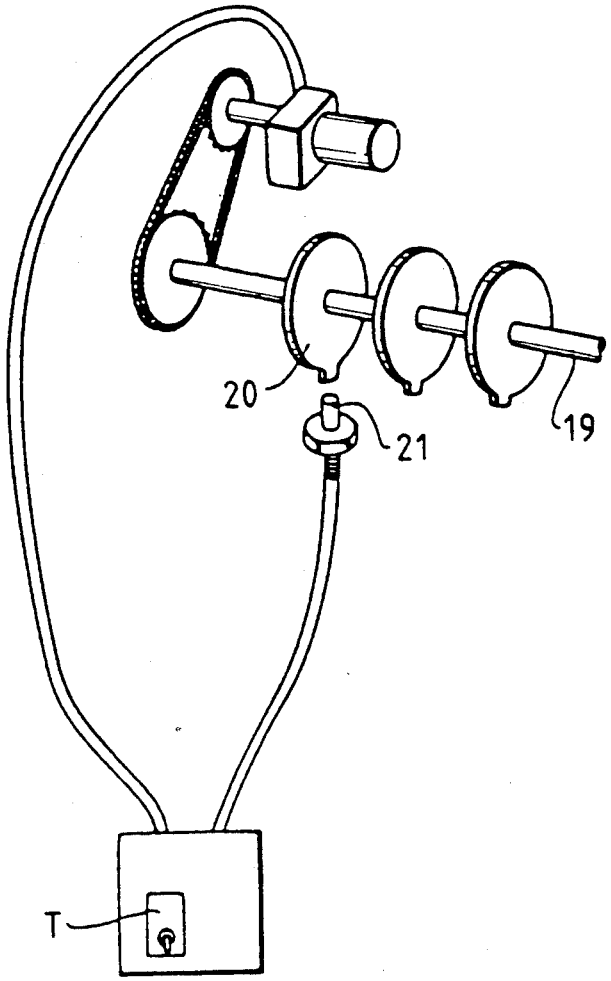
FIG. 5 is a schematic view showing a cam mechanism within an auto doffer.
Figure 9:
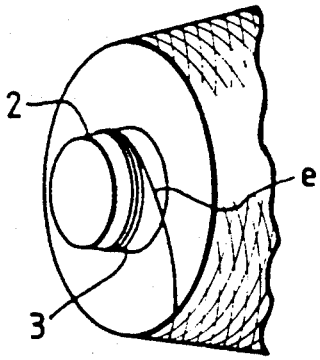
FIG. 9 PRIOR ART
FIG. 9 is a perspective view showing a conventional yarn processing method to a winding tube.
Figure 10:
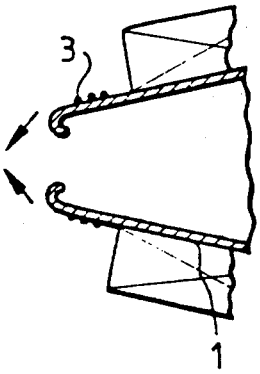
FIG. 10 PRIOR ART
FIG. 10 is a sectional view showing a conventional yarn processing method to a paper tube.

In the present embodiment, the limit of movement of the guide lever 7 is set so as to form the bunch winding 3 shown in FIG. 9. A timing cam 20 is added as shown in FIG. 5, and a timer T is actuated to set an amount of winding after the timing has been sensed by a sensor 21. When the set time of the timer T is reduced, the state being dropped at the end (out of traverse) on the small diameter side of the package P results, enabling the formation of the bunch winding 3 as shown in FIG. 1.

As described above, in the present invention, the tail end e of the package P is dropped at the end from the yarn layer iP to cross the end T of the package P, after which it is returned onto the yarn layer iP and wound. Therefore, the position of the tail end e is definitely specified, and the removal of the tail end in the later step is facilitated. Further, since the frictional resistance caused by the yarn layer iP is large, the yarn i can be wound from the small diameter side even on the core 2 of the paper tube having bent ends, etc. without the tail end e being slipped out of the yarn layer iP.

In short, according to the present invention, the tail end of the package is dropped at the end from the yarn layer to cross the end of the package, after which the tail end is returned onto the yarn layer. Therefore, the position of the tail end is definitely specified, and the removal of the tail end in the later step is facilitated without being slipped out of the core.

What is claimed is:

1. A yarn processing method comprising the steps of:
winding a package with a yard to produce a yarn package, the yarn package including a tail end,
dropping the tail end of the yarn package at a predetermined end of the yard package, the tail end being dropped from a predetermined layer of the yarn package,
crossing the predetermined end of the yarn package with the dropped tail end, and
returning the tail end of the yarn package to the predetermined layer of the yarn package.

2. A yarn processing apparatus for a tail end of a yarn package comprising:
a L-shaped lever for movably retaining a yarn being wound on the package,
a guide lever rotatably mounted on the L-shaped lever for guiding the movably retained yarn toward a predetermined end of the package along an axial direction of the package, and
a guide lever controlling means for controlling the position of the guide lever such that the tail end of the package drops from a yarn layer of the package so as to cross the end of the package and returns to the yarn layer.

3. A yarn processing apparatus according to claim 2, wherein the guide lever controlling means includes:
a lever shaft for rotating the L-shaped lever,
a lever support member provided on the lever shaft,
a cam lever, rotatably mounted on the lever support member, and provided with a cam portion formed thereon, and
a lever, connected with the guide lever, the lever having a shaft provided with a roller which movably engages the cam portion of the cam lever.

4. A yarn processing method for a tail end of a yarn package comprising the steps of:
movably retaining a yarn being wound on the package, guiding the movably retained yarn toward a predetermined end of the package along an axial direction of the package, and controlling the position of the movably retained yarn such that the tail end of the package drops from a yarn layer of the package, disposing the tail end of the yarn package across the predetermined end of the package, and returning the tail end of the package to the yarn layer.

* * * * *